US009908541B2

(12) United States Patent
Centeno et al.

(10) Patent No.: US 9,908,541 B2
(45) Date of Patent: Mar. 6, 2018

(54) RAILCAR BRAKE BEAM ASSEMBLY AND RELATED METHOD OF DESIGNING A RAILCAR BRAKE BEAM ASSEMBLY

(71) Applicants: Joseph Centeno, Kenosha, WI (US); Brian A. Senn, South Milwaukee, WI (US)

(72) Inventors: Joseph Centeno, Kenosha, WI (US); Brian A. Senn, South Milwaukee, WI (US)

(73) Assignees: MINER ENTERPRISES, INC., Geneva, IL (US); POWERBRACE CORPORATION, Kenosha, WI (US)

( * ) Notice: Subject to any disclaimer, the term of this patent is extended or adjusted under 35 U.S.C. 154(b) by 0 days.

(21) Appl. No.: 14/979,833

(22) Filed: Dec. 28, 2015

(65) Prior Publication Data

US 2017/0183020 A1 Jun. 29, 2017

(51) Int. Cl.
*B61H 13/00* (2006.01)
*B61H 13/36* (2006.01)
*B61H 1/00* (2006.01)

(52) U.S. Cl.
CPC ..... *B61H 13/36* (2013.01); *B61H 1/00* (2013.01)

(58) Field of Classification Search
CPC ..... B61H 13/36; B61H 1/00
See application file for complete search history.

(56) References Cited

U.S. PATENT DOCUMENTS 87,278 A 2/1869 Montgomery
2,431,914 A 12/1947 Brown
2,525,762 A 10/1950 Basell
2,723,008 A 11/1955 Cottrell
2,808,906 A 10/1957 Busch
3,020,984 A 2/1962 LeBeau
3,094,196 A 6/1963 Sewger
4,094,253 A 6/1978 Gage
(Continued)

OTHER PUBLICATIONS

Fred Carlson; Analysis of Commonly Used Body-and Truck-Mounted Brake Rigging; Sep. 1999; 18 pages; Transportation Technology Center, Inc.:Chicago, Illinois, USA.

*Primary Examiner* — Pamela Rodriguez

(74) *Attorney, Agent, or Firm* — Law Office of John W. Harbst

(57) ABSTRACT

A railcar brake beam assembly including a brake beam formation having a tension member, a compression member and strut, and with the strut defining an axis for the brake beam assembly. First and second brake head assemblies are disposed to opposite lateral sides of the axis, with each brake head assembly being operably carried by the brake beam formation and includes a guide member extending in a direction away from the axis. The first and second brake head assemblies are generally centered laterally relative to the axis of the brake beam assembly. A distal end of the guide member on the first brake head assembly is disposed a different lateral distance from the axis of the brake beam assembly than is a distal end of the guide member on the second brake head assembly to minimize lateral shifting movements while maintaining adequate clearances for permitting reciprocal moments of the brake beam assembly during application of braking forces. A method of designing a brake beam assembly for a railcar is also disclosed.

19 Claims, 4 Drawing Sheets

(56) References Cited

U.S. PATENT DOCUMENTS

| | | | | |
|---|---|---|---|---|
| 4,471,857 | A | 9/1984 | Murphy | |
| 4,830,148 | A * | 5/1989 | Hart | B61H 13/36 188/219.1 |
| 5,421,437 | A | 6/1995 | Malachowski | |
| 5,456,337 | A | 10/1995 | Jackson | |
| 5,682,964 | A | 11/1997 | Murphy | |
| 5,924,654 | A | 7/1999 | Anderson | |
| 6,367,590 | B1 | 4/2002 | Burke | |
| 7,430,794 | B2 | 10/2008 | Steffen | |
| 7,527,131 | B1 | 5/2009 | Wike | |
| 8,104,590 | B2 | 1/2012 | Fortuna et al. | |
| 8,225,912 | B2 | 7/2012 | Dalman et al. | |
| 8,256,585 | B2 | 9/2012 | Halford et al. | |
| 8,474,578 | B2 | 7/2013 | Halford et al. | |
| 2011/0253492 | A1* | 10/2011 | De la Fuente Farias | B61H 13/36 188/223.1 |

* cited by examiner

RAILCAR BRAKE BEAM ASSEMBLY AND RELATED METHOD OF DESIGNING A RAILCAR BRAKE BEAM ASSEMBLY

FIELD OF THE INVENTION DISCLOSURE

The present invention disclosure generally relates to a railcar brake beam assembly and, more specifically, to a brake beam assembly configured to minimize lateral shifting movements of the brake beam assembly during application of braking forces.

BACKGROUND

Each end of a railroad freight car typically includes two wheel and axle assemblies mounted between a pair of laterally spaced side frame members of a railcar truck. A laterally elongated bolster extends between and is supported by the side frames. A body of the railcar is supported on the bolster. Wheels are fit onto axles of each assembly to allow the railcar to ride over rails between locations. Toward the inner sides thereof, each wheel is provided with a radial flange which operably engages an inner side of the respective rail to inhibit excessive lateral displacement of the trucks thus keeping the trucks and railcar on the rails or tracks.

A typical railroad freight car further has a braking system including a brake beam assembly arranged in operable combination with each wheel and axle assembly on the car. Each brake beam assembly is provided with brake shoes for engaging the wheels to apply braking forces to the railcar. Each brake beam assembly is supported between the side frames of each truck to allow it to be operated into and out of braking positions in relation to the respective wheel and axle assembly. The opposed side frames each include guide brackets or pockets formed on an inner side of each side frame member. To support the brake beam assembly between the side frames, each brake beam assembly further includes an extension, extension lug, extension head, or paddle (hereinafter referred to as "guide member") projecting outwardly from opposed ends of the brake beam formation and which are guidingly accommodated and received for reciprocal sliding movements within the guide brackets or pockets on the side frame members. Typically, wear liners are positioned within each guide bracket or pocket on the side frame to receive and slidably accommodate the respective guide member of the brake beam assembly therewithin.

One form of brake beam assembly commonly used in the railcar industry primarily includes a brake beam formation including compression and tension members joined to each other toward their ends where a brake head assembly is located and are separated at the middle by a fore-and-aft extending strut. It has been found beneficial for the brake beam formation to maintain both a degree of camber in the compression member and a degree or level of tension in the tension member. Each brake head assembly includes a brake head which carries a brake shoe thereon. The brake head assembly has a guide member arranged in operable association therewith. Moreover, the guide members extend in opposed direction relative to each other from the joined ends of the compression member and tension member.

The brake beam assemblies on the car are operated in simultaneous relation by a power source from a brake cylinder or hand brake and, through brake rigging, transmit and deliver braking forces to the brake shoes at the wheels of each wheel and axle assembly. On a typical railcar, the brake rigging, including a brake push rod, transmits forces, caused by the push of air entering the brake cylinder or the pull of the hand brake, to the brake shoes.

The brake rigging on the railcar, used to transmit and deliver braking forces to the brake shoes for each wheel, includes a multitude of linkages including various levers, rods and pins. For example, brake levers are used throughout the brake rigging on each car to transmit as well as increase or decrease the braking force directed to each wheel and axle assembly. The distance between various holes or openings on the brake levers determines the level of force transmitted to or between the various levers. Besides transferring force, the linkages of the brake rigging can also be used to change the direction of the force.

The strut on a conventional brake beam assembly defines an axially elongated slot which pivotally accommodates either a dead or a live lever. The levers are pivotally supported by the strut of the respective brake beam assembly. One end of the live truck lever is articulately connected to a longitudinally elongated top rod whose opposite end is connected to the cylinder lever of the railcar brake rigging. As is known, and besides being pivotally supported by the strut of the other brake beam assembly on the wheeled truck, the dead truck lever is articulately connected, intermediate the strut and the free end thereof, to the live truck lever. The free end of the dead truck lever is typically fulcrumed to the truck bolster or car body by a guide used to adjust the brakes.

To effectively lower the upper end of the brake lever relative to the position it would otherwise occupy if the brake lever were vertical, such brake levers are typically inclined or slanted lengthwise of the brake beam a certain number of degrees. That is, each brake lever, pivotally supported by the strut on each brake beam assembly, is inclined at an angle ranging between about 35 degrees and about 55 degrees relative to a horizontal plane.

The brake levers on each brake beam assembly are disposed to opposite sides of the bolster and are interconnected by a through rod or connecting rod. The live brake lever is also connected to the brake rigging. The most common through-rod rigging uses truck levers of unequal length. The live and dead levers have the same lever ratio, usually 2 to 1, which causes the through rod or connecting rod to ride at an angle to the longitudinal centerline of the railcar. As such, and during operation of the brake beam assemblies, the brake beam formations are forced to move laterally outward due to the lateral force component exerted thereon by the truck through rod. That is, and upon application of a braking force to the brake beam assembly, forces from the through rod to the live lever and dead lever has both a longitudinal and lateral components thereto. The lateral force applied to the brake beam assembly can be substantial especially when the braking force used to control the speed of the car is enhanced due to any number of forces acting on the car.

During operation, the side frames on each truck tend to shift with respect to one another. For example, when the railcar trucks are going around a bend, or when the commodity supported and carried by the car shifts or changes, the lateral distance between the side frames of each truck changes. The side frames can tend to shift inward, which causes the brake beam formation to be squeezed between the side frames of the truck. As such, the brake beam assembly is typically designed to yield a gap or clearance between the distal ends of the laterally spaced guide members on each brake beam assembly and the side frames to avoid having the brake beam assembly bind during operation.

Such gap or clearance, however, may be too wide is some situations, such as when the brake beam is off-center or kinked out of alignment. The aformentioned lateral movement or side thrust applied to the brake beam assembly can cause one of the brake shoes and the brake head to ride into contact with the wheel flange on one of the wheels which can result in wheel wear. Damage or wearing of the wheels on a railcar, for whatever reason, can result in significant repair expenses. Moreover, the aformentioned lateral movement or side thrust applied to the brake beam assembly can result in excessive wear and damage to the brake shoe and/or brake head while the mating shoe on the same brake beam assembly tends to ride on or overhang the outer edge of the opposed wheel. As used herein and throughout, the phrases or terms "overhang" or "overhanging" means and refers to either brake shoe laterally extending past an inner edge of the respective railcar wheel. Brake beam assemblies with unequal length brake levers commonly display wear patterns such as brake heads worn away by wheel flanges on diagonal corners of the wheel and axle assemblies. This leads to some wheels working harder to stop or control the speed of the car.

Besides serving to slidably support the brake beam assembly between the side frames and relative to the axis of the axle, the guide extensions or members operably associated with each brake beam assembly furthermore serve to establish a wear surface with each wear liner on the side frame. In these instances where the wear liner is fabricated from a metallic material, the guide member contact surfaces work with the wear liner to create smooth sliding surfaces whereby promoting reciprocatory movements of the brake beam assembly during operation. Of course, if the guide members on the brake beam assembly cannot smoothly ride within the wear liners, stress concentration are created and tend to hinder proper operation of the brake beam assembly.

Thus, there is a continuing need and desire for a railcar brake beam assembly designed to overcome the above-mentioned drawbacks and conditions mentioned above.

SUMMARY

In view of the above, and on accordance with one aspect of this invention disclosure, there is provided a railcar brake beam assembly including a brake beam formation including a tension member, a compression member and strut disposed between and operably joined to the tension member and the compression member. The strut defines an axis for the brake beam assembly and serves to pivotally mount a brake lever for pivotal movement about a fixed axis. First and second brake head assemblies are disposed to opposite lateral sides of the axis, with each brake head assembly being operably carried by the brake beam formation and includes a guide member extending in a direction away from the axis. The first and second brake head assemblies are generally centered laterally relative to the axis of the brake beam assembly. A distal end of the guide member on the first brake head assembly is disposed a different lateral distance from the axis of the brake beam assembly than is a distal end of the guide member on the second brake head assembly to minimize lateral shifting movements while maintaining adequate clearances for permitting reciprocal moments of the brake beam assembly during application of braking forces.

The strut of the brake beam formation defines an elongated slot which accommodates at least a portion of the brake lever. In a preferred embodiment, and when the brake beam assembly is mounted on the railcar, both the slot in the strut and the brake lever are slanted at a predetermined angle relative to a horizontal plane to allow the operable height of the brake lever to be reduced. In a preferred form, each brake head assembly includes a brake head, a brake shoe removably attached to the brake head, and with the guide member being formed as integral part of the brake head. In one embodiment, each brake head assembly operably interconnects adjacent ends of the tension member and the compression member to each other.

In one form, and to reduce friction during reciprocal movements of the brake beam assembly, the guide member on each brake head assembly preferably includes two free-ended lobes extending in generally coplanar relation relative to each other The lobes of each guide member are preferably separated from each other as they extend away from the distal end thereof.

According to another aspect of this invention disclosure, there is provided a brake beam assembly for a railcar having laterally spaced side frames mounting at least one axle therebetween. The axle carries a pair of wheels, with each wheel having a radial flange thereon. In accordance with this aspect of the invention disclosure, the brake beam assembly includes a brake beam formation including a tension member, a compression member and strut. The strut is disposed between and operably joined to the tension member and the compression member and defines an axis for the brake beam assembly. The strut serves to mount a brake beam lever for pivotal movement about a fixed axis. First and second brake head assemblies are disposed to opposite lateral sides of the axis. Each brake head assembly is adapted to apply a braking force to a respective one of the flanged wheels in response to actuation of the brake beam lever. Each brake head assembly is operably carried by the brake beam formation and includes a guide member extending in a direction away from the axis. The brake head assemblies are generally centrally disposed laterally relative to the axis of the brake beam assembly. In accordance with this aspect of the invention disclosure, the brake beam assembly is configured such that distal ends of the guide members on the first and second brake head assemblies are disposed different distances from the axis of the brake beam assembly so as to inhibit a brake shoe carried by either brake head assembly from engaging the flange on either wheel upon actuation of the brake beam lever and whereby yielding an asymmetrical design to the brake beam assembly The strut of the brake beam formation preferably defines an elongated slot which accommodates at least a portion of the brake lever. When the brake beam assembly is mounted on the railcar, the slot in the strut and the brake lever are preferably slanted at a predetermined angle relative to a horizontal plane to allow an operable height of the brake lever to be reduced. In a preferred form, a distal end of the guide member on the first brake head assembly is disposed a different lateral distance from the axis than is a distal end of the guide member on the second brake head. assembly whereby yielding an asymmetrical design to the brake beam assembly. Preferably, each brake head assembly includes a brake head, a brake shoe removably attached to said brake head, and with the guide member being formed as integral part of said brake head. In one form, each brake head assembly operably interconnects adjacent ends of the tension member and the compression member to each other.

In a preferred embodiment, the guide member on each brake head assembly includes two free-ended lobes extending in generally coplanar relation relative to each other. The lobes of each guide member are preferably separated from each other as they extend away from the distal end thereof.

In accordance with another aspect of this invention disclosure, there is provided a brake beam assembly for a railcar having laterally spaced side frames mounting at least one axle therebetween. The axle carries a pair of wheels, with each wheel having a radial flange thereon. Each truck presents on an inboard side thereof a guide recess. The brake beam assembly includes a brake beam formation including a tension member, a compression member and strut disposed between and operably joined to the tension member and the compression member. The strut defines an axis for the brake beam assembly and serves to mount a brake beam lever for rotation about a fixed axis. First and second brake head assemblies are arranged a generally equal lateral distance relative to and on opposite lateral sides of the axis. Each brake head assembly is adapted to apply a braking force to a respective one of the flanged wheels in response to actuation of the brake beam lever. Each brake head assembly is operably carried by the brake beam formation and includes a guide member extending in a direction away from the axis. The guide member of each brake head assembly is slidably supported for reciprocal movements within the guide recess defined by the inboard side of the laterally adjacent truck. The brake beam assembly is configured such that distal ends of the guide members on the first and second brake head assemblies are disposed different distances from the axis for the brake beam assembly so as to inhibit a brake shoe carried by either brake head assembly from overhanging either wheel upon actuation of the brake beam lever whereby optimizing brake beam assembly performance.

The strut of the brake beam formation an elongated slot which accommodates at least a portion of the brake lever and is preferably slanted at a predetermined angle relative to a horizontal plane whereby permitting an operable height of the brake lever to be reduced when the brake beam assembly is mounted on the railcar. Preferably, a distal end of the guide member on the first brake head assembly is disposed a different lateral distance from the axis of the brake beam assembly than is a distal end of the guide member on the second brake head assembly whereby yielding an asymmetrical design to the brake beam assembly. Each brake head assembly includes a brake head, a brake shoe removably attached to said brake head, and with the guide member being preferably formed as integral part of the brake head.

In a preferred embodiment, each brake head assembly operably interconnects adjacent ends of the tension member and the compression member to each other. The guide member on each brake head assembly preferably includes two free-ended lobes extending in generally coplanar relation relative to each other. The lobes of each guide member are preferably separated from each other as they extend away from the distal end thereof.

In accordance with another aspect of this invention disclosure there is provided a method of designing a brake beam assembly for a railcar having laterally spaced side frames mounting at least one axle therebetween. The axle carries a pair of wheels, with each wheel having a radial flange thereon. The brake beam assembly includes a brake beam formation including a tension member, a compression member and strut disposed between and operably joined to the tension member and the compression member. The strut defines an axis for the brake beam assembly and serves to mount a brake beam lever for pivotal movement about a fixed axis. First and second brake head assemblies are disposed to opposite lateral sides of the axis, with each brake head assembly being adapted to apply a braking force to a respective one of the flanged wheels in response to actuation of the brake beam lever. Each brake head assembly is operably carried by the brake beam formation and includes a guide member extending in a direction away from the axis. The first and second brake head assemblies are generally centrally disposed laterally relative to the axis of the brake beam assembly. The method of designing a brake beam assembly for a railcar comprises the steps of: determining in which lateral direction the brake beam formation is going to move upon actuation of the brake beam lever; and configuring the brake beam assembly so as to allow the brake beam assembly to reciprocate relative to the trucks and such that distal ends of the guide members on said first and second brake head assemblies are disposed different distances from the axis for said brake beam assembly to inhibit a brake shoe carried by either the first or second brake head assembly from engaging with the flange on either wheel upon actuation of the brake beam lever whereby optimizing brake beam assembly performance.

DETAILED DESCRIPTION OF THE DRAWINGS

DETAILED DESCRIPTION

Figure 1:
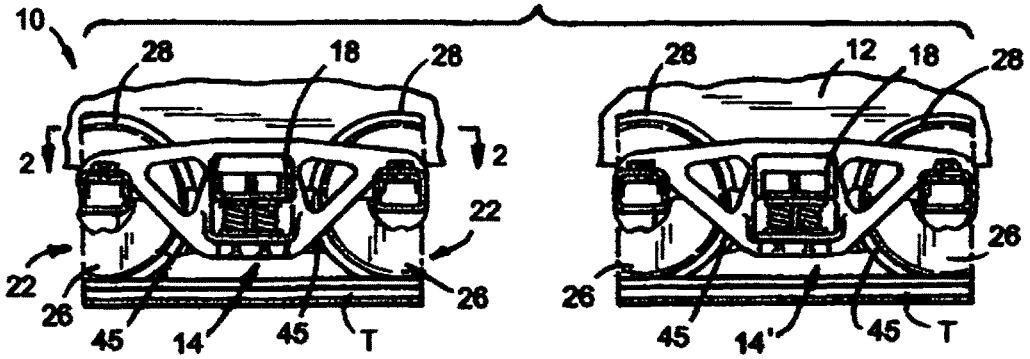
FIG. 1 is a fragmentary side elevational view of a railroad car having railcar trucks arranged toward opposed ends thereof.

While this invention disclosure is susceptible of embodiment in multiple forms, there is shown in the drawings and will hereinafter be described a preferred embodiment, with the understanding the present disclosure is to be considered as setting forth an exemplification of the disclosure which is not intended to limit the disclosure to the specific embodiment illustrated and described.

Referring now to the drawings, wherein like reference numerals indicate like parts throughout the several views, FIG. 1 shows a railroad car 10 including a car body 12. As is know, the car body 12 is supported, toward opposite ends thereof, in operable combination with a pair of wheeled trucks 14 and 14' for movement over rails or tracks T. The wheeled trucks 14, 14' are substantially similar to each other and, thus, only wheeled truck 14 will be described in detail, Turning to FIG. 2, each railcar truck includes, in general, a pair of laterally spaced side frames 18, 18' with a bolster 20 laterally extending between and operably supported by the side frames 18, 18'. The side frames 18, 18' also serve to mount a wheel and axle assembly 22 to opposite sides of the bolster 20. Each wheel and axle assembly 22 includes an axle 23 which rotates about a fixed axis 24. Moreover, each wheel and axle assembly 22 includes a pair of laterally spaced wheels 26, 26' toward opposed ends of each axle 23. As is conventional, each wheel 26, 26' has a radial flange 28 which, during movement of the railcar 10, cooperates with the rail or track T to limit lateral movements of the car 10.

Figure 2:
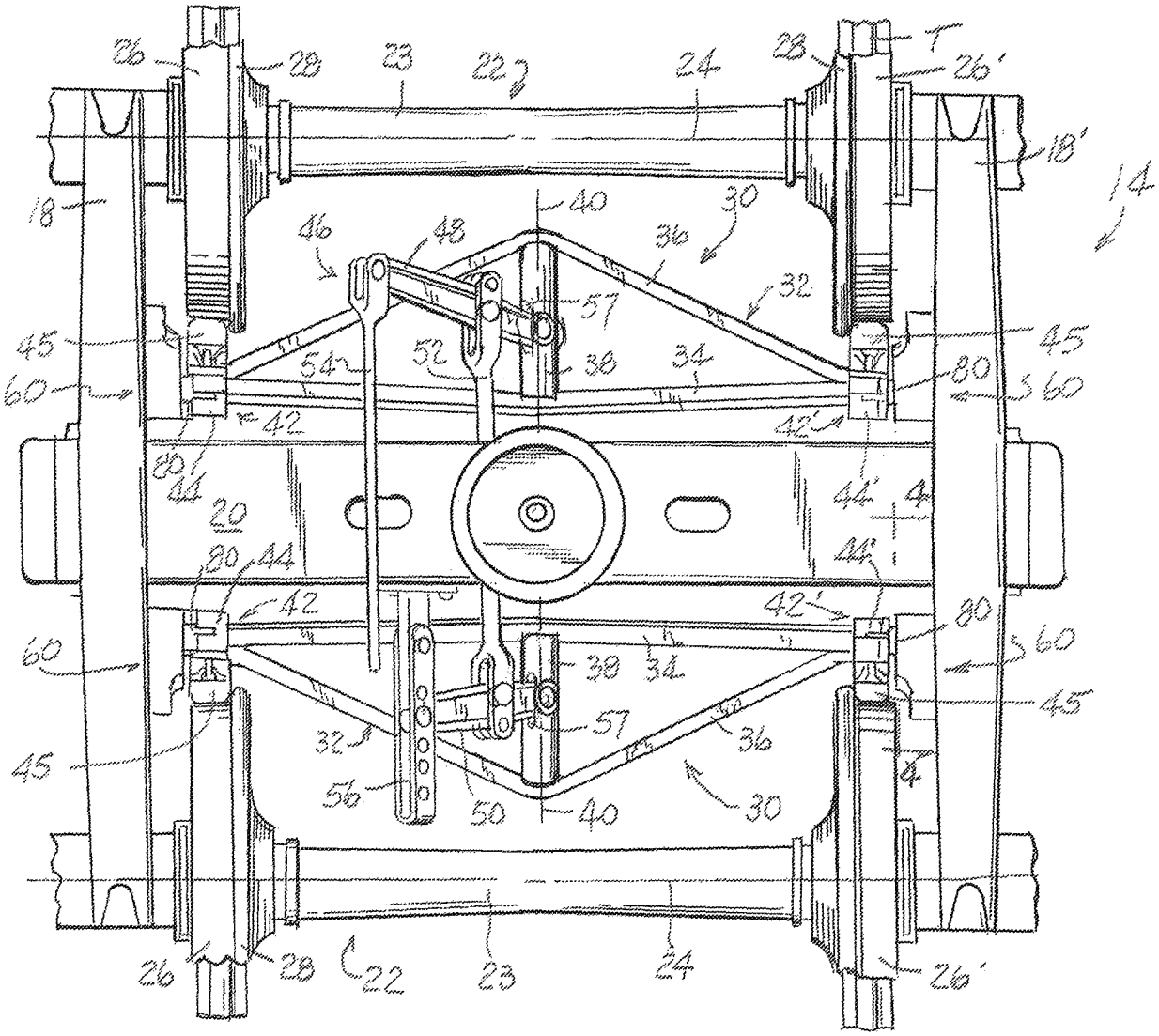
FIG. 2 is a plan view of one set of railcar trucks taken along line 2-2 of FIG. 1.

Each wheel and axle assembly 22 on car 10 has a brake beam assembly 30 arranged in operable combination therewith. As shown in FIG. 2, each brake beam assembly 30 includes several interrelated components associated therewith. Each brake beam assembly 30 is laterally disposed to one or the other side of the bolster 20 and laterally extends between the side frames 18, 18 for guided reciprocal movements.

Figure 3:
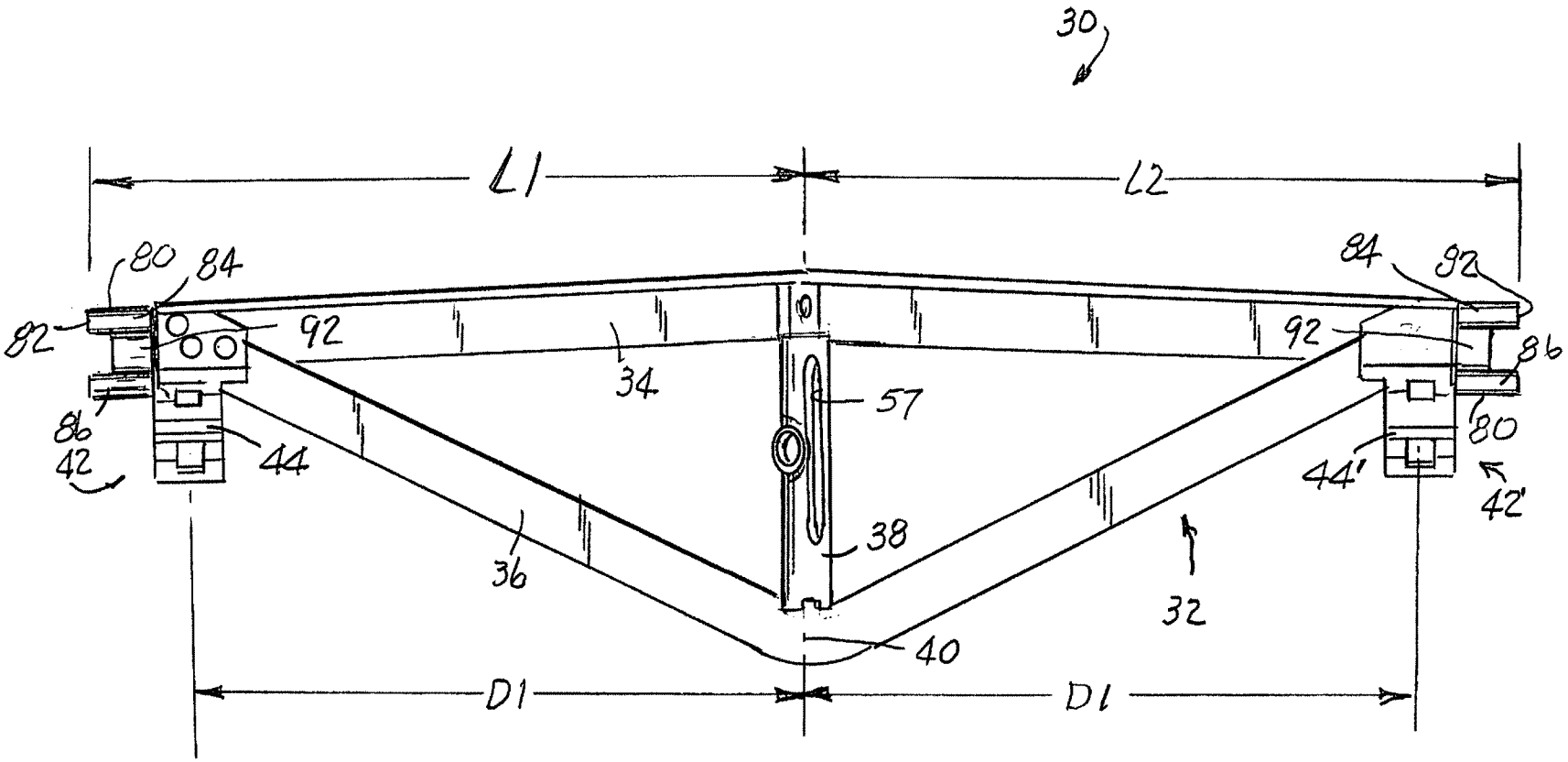
FIG. 3 is an enlarged top plan view of a railcar brake beam assembly.

In the embodiment shown by way of example in FIGS. 2 and 3, each brake beam assembly 30 has a brake beam formation 32 including a compression member 34, a tension member 36 bent in the form of a V and operably connected toward its ends toward the ends of the compression member 34, and a strut 38 operably arranged between the apex of the tension member 36 and the mid-section of the compression member 34 for maintaining tension in the tension member 36 and camber in the compression member 34. The strut 38 is operably connected in a conventional manner toward opposite ends to the compression member 34 and tension member 36. Moreover, strut 38 defines an axis 40 for each brake beam assembly 30.

In the embodiment shown by way of example in FIG. 2, first and second brake head assemblies 42 and 42' are disposed to opposite lateral sides of the axis 40 of the brake beam assembly. Each brake head assembly 42 is operably carried toward the one end of and by the brake beam formation 32. Each brake head assembly 42, 42' includes a brake head 44 and a brake shoe 45 (FIG. 2) carried by and removably attached to the brake head 44. Each brake shoe 45 is adapted for engagement with a respective one of the wheels 26, 26' in braking position.

In a preferred embodiment, the first and second brake head assemblies 42, 42' are each configured in substantial accordance with the Association of American Railroads "Manual of Standards and Recommended Practices", Section E, TRUCKS AND TRUCK DETAILS, Standard S-345, "Applicable Tolerances for Brake Beams, Hangerless Types" (See FIG. 12, page D-213). In particular, the brake head assembly embodiments of the present disclosure are in substantial accordance with American Association of American Railroads, Standard S-371, "LIMITING CONTOUR OF BRAKE HEADS FOR HANGERLESS TYPE BRAKE BEAMS", appearing on page E-250 of such publication.

The brake shoes 45 are moved into and out of braking relation with the wheels 26, 26' of respective wheel and axle assembly 22 through brake rigging, generally indicated in FIG. 2 by reference numeral 46, which is responsive to operation of an air cylinder (not shown) or a hand brake mechanism (not shown). In the form shown in FIG. 2, the brake rigging 46 for moving the brake beam assemblies 30 into and out of braking relation is shown to include a live brake lever 48 pivotally secured to a brake beam strut 38 of one brake beam assembly 30 and a dead brake lever 50 pivoted to the brake beam strut 38 of the other or related brake beam assembly 30. In one form, the brake levers 48 and 50 are of unequal length relative to each other. A connecting rod 52 extends between and joins the brake levers 48 and 50 such that the levers have the same lever ratio, usually 2 to 1. Moreover, in the embodiment illustrated by way of example in FIG. 2, an operating rod 54 is articulately connected toward the upper end of the live brake lever 48 and is actuated by a conventional air or conventional hand brake device (not shown) on the car 10 (FIG. 1). In the embodiment illustrated by way of example in FIG. 2, the dead brake lever 50 is connected to an adjusting link 56.

In the illustrated embodiment, the strut 38 of each brake beam assembly 30 defines an elongated slot 57 which allows at least a portion of the respective brake lever to be supported by the strut for pivotal movement about a fixed axis. As a result of the ever increasing size of freight cars together with the tendency to use of a bottom hole on the lever for the brake beam connection, the brake levers have tended to increase in their length. As such, and to operably lower the upper end of each brake lever, and after the strut is operably connected to the compression member 34 and tension member 36, the slot 57 and thereby the lever carried thereby is inclined or slanted a predetermined number of degrees from vertical. In one embodiment, each lever 48, 50 is slanted or inclined at an angle of about 40 degrees from vertical.

When the forces from the operating rod 54, the connecting rod 52 and the brake beam formation are no longer in line relative to each other, a lateral torque or force about the longitudinal axis of the brake beam formation is developed. This torque tends to increase the load on one brake shoe of the brake beam assembly 30 while decreasing the load on the other brake shoe of the brake beam assembly. This causes one brake shoe 45, and sometimes the respective brake head 44, on the brake beam assembly 30 to contact or rub against the flange 28 of the adjacent wheel resulting in premature wear and potential failure of either the brake head 44, the brake shoe 45 or both while the opposite brake shoe 45 on the other brake head assembly tends to overhang the respective wheel resulting in uneven wear of the brake shoes. Moreover, microcracks and damage to the side of the wheel due to the brake shoe overhanging the wheel can result.

The brake beam assemblies on opposed sides of the bolster 20 are each conventionally supported in the usual manner by the side frames 18, 18' at spaced locations so as to slidably mount the respective brake beam assemblies for reciprocal movements whereby the brake shoes 45 are applied to the respective set of wheels when the brake are to be applied. As illustrated by way of example in FIG. 2, the side frames 18, 18' each include structure 60 (with only one structure being shown in FIG. 4 on side frame 18' for purposes of this description) for guiding and supporting each brake beam assembly 30.

Figure 4:
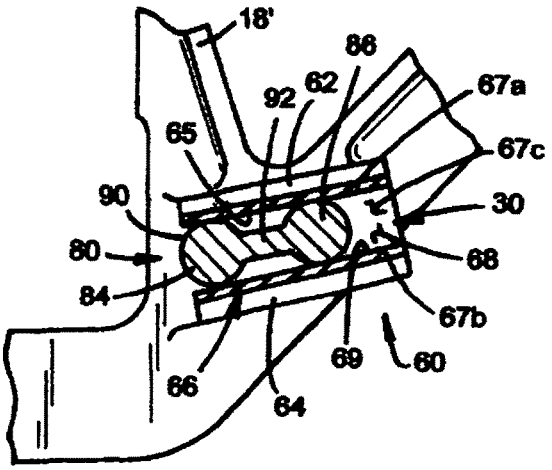
FIG. 4 is a fragmentary and enlarged side view taken along line 4-4 of FIG. 2.

As shown in FIG. 4, each structure 60 preferably includes a pair of vertically spaced and generally parallel guides or flanges 62 and 64 usually formed integral with and extending from an inboard side of each frame to define an open-sided channel or recess 65 therebetween. Each channel or recess 65 extends for a length at least equivalent to the extent of travel of the brake beam assembly 30 during a braking application process. In the specific embodiment illustrated, the guides 62, 64 are configured such that the recess 65 slants upwardly toward the axis 24 (FIG. 2) of the respective wheel and axle assembly 22 and relative to a generally horizontal plane.

As suggested in the larger scale showing in FIG. 4, each support structure 60 can further include a wear liner 66 which is accommodated within the recess or pocket 65 defined by the guides or flanges 62 and 64 of each support structure 60. Each wear line 66 is typically formed from a spring steel sheet or other suitable material having a thickness of about 3/16 (0.1875) inch. Typically, the wear liner 66 is snugly fit and held within the open-sided channel or recess 65 defined by each support 60.

Optionally, the wear liner 66 has a generally U-shaped transverse cross-sectional configuration including a generally flat or planar upper web 67*a*, a generally flat or planar lower web 67*b* and a generally vertical web 67*c* joining the webs 67*a* and 67*b* and which defines an interior surface 68. When accommodated in the pocket or recess 65 of each structure 60, the inner surfaces of the upper and lower webs 67*a* and 67*b* of liner 66 are disposed in substantially parallel relation relative to each other and define a pocket or recess 69 therebetween.

With the exception of the differences listed below, the first and second brake head assemblies 42, 42' arranged toward opposite ends of the brake formation 32 are substantially similar to each other. As such, only brake head assembly 42 will be described in detail in connection with FIGS. 5 and 6.

Figure 5:
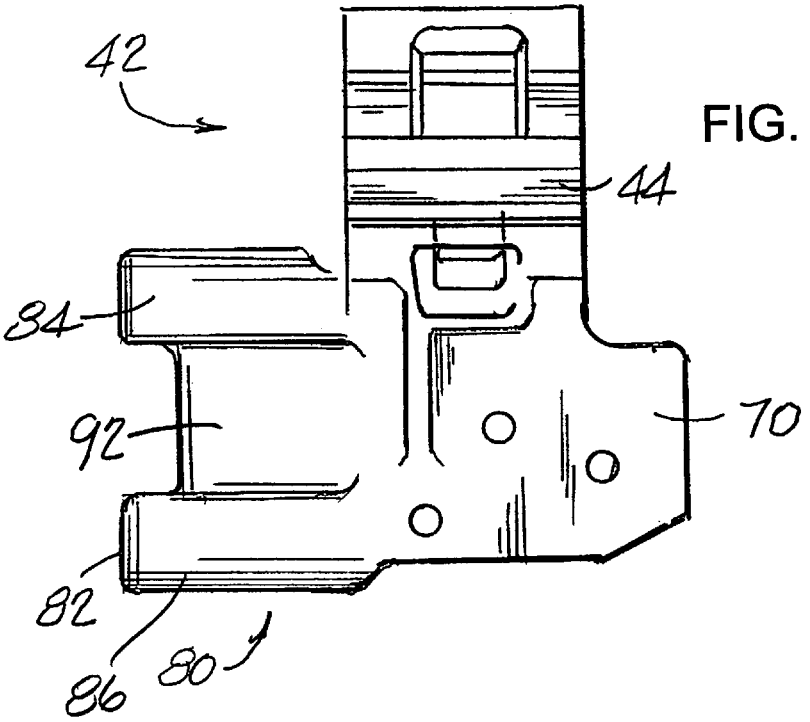
FIG. 5 is a top plan view of one form of brake head embodying features of the present invention disclosure.
Figure 6:
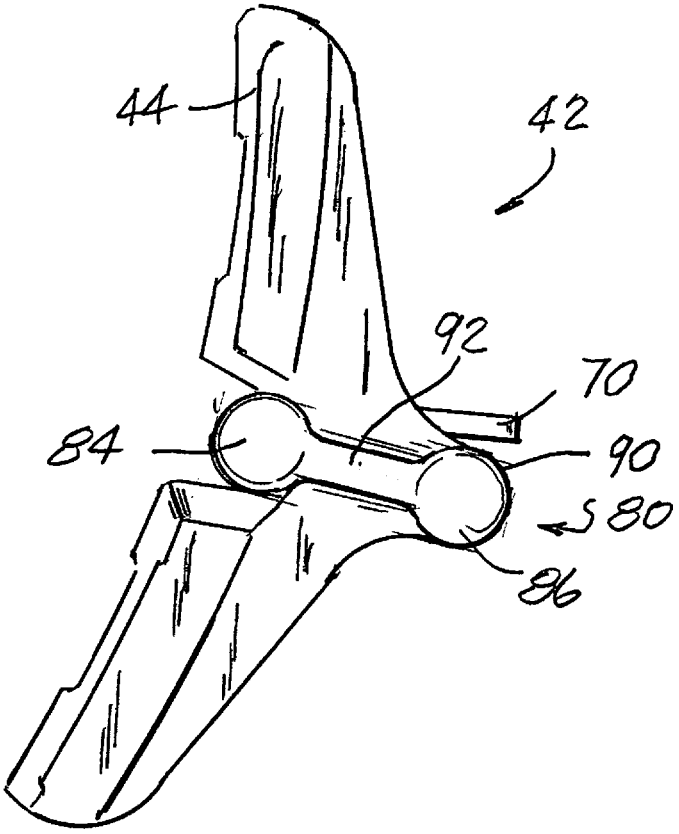
FIG. 6 is a left side elevational view of the brake head illustrated in FIG. 5.

Turning to FIG. 5, and besides the brake head 44, each brake head assembly preferably includes an attachment portion 70 secured to and extending in a first generally lateral inward direction from the brake head 44. Preferably, the attachment portion 70 of each brake head assembly 42 is configured to facilitate securement of the brake head assembly toward one end of the compression member 34 and tension member 36 (FIG. 2).

Each brake head assembly furthermore includes a guide member 80 operably associated therewith. The guide member 80 is secured to and extends in a second generally lateral outward direction from the brake head 44. In the illustrated embodiment, the guide member 80 is formed as an integral part of each brake head 44. It should be appreciated, however, guide member 80 can be formed separate from but then operably secured to the brake head without detracting or departing from the spirit and scope of this invention disclosure. Notably, the guide member 80 of each brake head assembly extends in a direction away from the axis 40 of the respective brake beam assembly (FIG. 2) and terminates in a free distal end 82 (FIG. 5). The guide members 80 at each end of the brake formation 32 are slidably accommodated in between the opposed support structures 60 on the inboard sides of the side frames 18, 18' for sliding movements toward and away from the respective wheel and axle assembly.

To accommodate reciprocal movements of the brake beam assembly 30 during braking operations, research has shown there is a gap or clearance between the interior surfaces 68 of the wear liners 66 on the side frames 18, 18' and the distal end 82 of the guide members 80 at opposed ends of the brake beam assembly 30. This gap or clearance tends to permit the brake assembly 30 to shift off-center between the side frames 18, 18' as a result of the aforementioned lateral torque or force pulling the brake beam assembly 30 toward one of the side frames 18, 18' during a braking operation and thereby causing one of the brake head assemblies 42 and respective brake head 44 to move laterally toward the adjacent wheel.

One salient feature of the present invention disclosure relates to configuring the brake beam assembly 30 to allow it to reciprocate relative to the side frames 18, 18' during a braking operation while maintaining the brake beam assembly and, more particularly, the brake shoes 45 of each brake head assembly centered on the wheels 26, 26' (FIG. 2). Moreover, another salient feature of this invention disclosure involves configuring the brake beam assembly 30 to allow it to reciprocate relative to the side frames 18, 18' during a braking operation while maintaining the brake beam assembly 30 centered between the wheels 26, 26' (FIG. 2). As such, the brake head 44 and brake shoe 45 of either brake head assembly 42 is inhibited from engaging with the flange 28 on the adjacent wheels of car 10 (FIGS. 1 and 2). An additional advantage yielded by configuring the brake beam assembly 30 to allow it to reciprocate relative to the side frames 18, 18' during a braking operation relates to inhibiting either brake shoe on the brake beam assembly from overhanging the respective wheel. In one embodiment, these advantageous results are accomplished by reducing the gap or clearance between the interior surface 68 of the wear liners 66 on the side frames 18, 18' and the distal ends of the guide members 80 at opposed ends of the brake beam assembly 30. Preferably, this is accomplished through a change in the geometric configuration of the brake head assemblies 42, 42' at opposed ends of the brake beam assembly 30 while maintaining the brake head assemblies 42, 42' at the ends of the brake beam assembly 39 centered relative to the respective wheels 26, 26'.

Returning to FIG. 3, and in accordance with the present invention disclosure, the first and second brake head assemblies 42, 42' of the each brake beam assembly are generally centrally disposed relative to the axis 40 of the brake beam assembly 30. With the present invention disclosure, a common or equal lateral length D1 is maintained between the brake heads 44 (and the brake shoes 45 carried thereby) and axis 40 of the respective brake beam formation 32 while an unequal length is maintained between a distal end 82 of the guide extension 80 on the first brake head assembly 42 and a distal end 82 of the guide extension 80 on the second brake head assembly 42. That is, a first lateral distance L1 separates the distal end 82 of the guide extension 80 on the first brake head assembly 42 from the axis 40 of the brake beam assembly 30 while a second lateral distance L2 separates the distal end 82 of the guide extension 80 on the second brake head assembly 42 from the axis 40 of the brake beam assembly 30; with the first and second lateral distances L1 and L2 being different and unequal to each other. As such, the brake beam assembly 30 of the present invention disclosure has an asymmetrical design configuration.

When the brake beam assembly 30 is fabricated, the brake head assembly 42 having the longer guide member or extension 80 thereon is operably secured to that end of the brake beam assembly 30 that tends to move toward the respective side frame during a braking application. Given the construction of the brake beam assembly 30 illustrated by way of example in FIG. 2, it has been determined such a brake beam assembly would tend to move to the left as seen in FIG. 2 upon actuation of the brake lever 48 during a braking operation. As such, the brake head assembly 44 on the left side of the brake beam assembly, as seen in FIG. 2, would have a guide member 80 which projects a further distance from the axis 40 of the brake beam assembly than does the guide member extension 80 on brake head assembly 44'. Accordingly, and during actuation of the brake lever 48 (FIG. 2) to effect a braking operation or function, movement of the brake beam assembly 30 to the left, as illustrated in FIG. 2 would be arrested by the distal end 82 of the longer guide member 80 engaging with the interior surface 68 of the wear liner 66 arranged in the pocket 65 of the support structure 60 (FIG. 4) operably associated with the side frame 18. Configuring the brake beam assembly 30 to arrest and/or limit lateral movement during a braking operation will advantageously inhibit the brake head assembly on the right side of the brake beam assembly 30, as illustrated in FIG. 2, from engaging with the flange 28 on the respective railcar wheel. Notably, the cumulative lateral length between the distal ends of the guide members 80, 80' (L1+L2) will be such to avoid the brake beam binding during a braking operation.

Another salient aspect of this invention disclosure relates to the configuration of the guide extension 80 operably associated with each brake head assembly 44. According to this aspect of the invention disclosure, the guide member 80 associated with each brake head assembly 42, 42' is configured to limit surface contact with the wear liner 66 securely arranged in each pocket 65 (FIG. 4) of each frame member 18, 18'. Research has shown, and albeit unavoidable, frictional contact between the wear liner 66 and the end guide 80 resists movements of the brake beam assembly 30 under load. As such, the design of the end guide 80 has been advantageously modified to minimize contact between the wear liner 66 and end guide 80 whereby minimizing resistence to movements while the end guide 80 slides over the wear liner 66.

This advantageous result has been accomplished by configuring the guide member 80 extending laterally outwardly from each end of the brake beam assembly 30 with two elongated and spaced free-ended lobes 84 and 86 attached to and extending or projecting outwardly from the brake head 44 of each brake head assembly 42, 42' (FIG. 3). In the illustrated embodiment, each lobe 84, 86 has a generally circular cross-sectional configuration along their lengths but it should be appreciated other cross-sectional configurations, i.e. rectangular, triangular, oblong, etc., would equally suffice without detracting or departing from the braid spirit and scope of this aspect of the invention disclosure.

As illustrated by way of example in FIG. 4, an outer surface 90 on each lobe 84, 86 is designed to slidably fit between and be guided by the upper and lower webs 67*a* and 67*b*, respectively, of a respective wear liner 66. Suffice it to say, the lobes 86, 88 are each configured to minimize surface contact on each side of the guide member 80 preferably at only the two spaced locations where the outer surface 90 on each lobe 84, 86 contacts the respective wear liner 66 rather than along a full surface line of contact across the entire face of the guide member as with conventional guide member configurations.

In the illustrated embodiment, the lobes 84 and 86 of each guide member 80 are rigidly maintained in spaced relation relative to each other by a central web 92 having a cross-sectional configuration which is substantially reduced relative to the outer surface 90 of each lobe 84, 86. In the illustrated embodiment illustrated in FIGS. 3 and 5, the central web 92 of each laterally extends for a majority of the length of and between the lobes 84 and 86 of each guide member 80. That is, in a preferred embodiment, the central web 92 extends for only a portion of the lengths of each lobe 84, 86. As such, and toward their distal ends, the lobes 84, 86 are separated from each other for a distance. The reduced cross-sectional configuration of the central web 92 minimizes the points of contact along the longer outer surfaces 90 of each lobe 84, 86 and thereby minimizes the resistence of the end guide 80 while gliding over the wear liner 66 during a braking operation. This enhanced design of each guide member 80 furthermore serves to reduce the weight of each end guide 80 as compared to conventional end guide designs.

Yet another aspect of this invention disclosure relates to a method of designing a brake beam assembly 30 for a railcar 10 (FIG. 1) having two laterally spaced side frames 18, 18' mounting at least wheel and axle assembly 22 therebetween. The axle 23 of assembly 22 carries a pair of wheels 26, 26'. Each wheel 26, 26' includes a radial flange 28 which combines with the rails over which the car 10 rides for controlling lateral movements of the car 10 (FIG. 1). The brake beam assembly 30 includes a brake beam formation 32 including a compression member 34, a tension member 36 and strut 38 disposed between and operably joined to the compression member 34 and tension member 36. The strut 38 defines an axis 40 for the brake beam assembly 30 and serves to mount a brake beam lever 48, 50 for pivotal movement about a fixed axis. First and second brake head assemblies 42, 42' are disposed to opposite lateral sides of the axis 40, with each brake head assembly 42, 42' being adapted to apply a braking force to a respective one of the wheels 26, 26' in response to actuation of the brake beam lever 48, 50. Each brake head assembly 42, 42' is operably carried by the brake beam formation 32 and includes a guide member 80 extending in a direction away from the axis 40 of the brake beam assembly 30. The first and second brake head assemblies 42, 42' are generally centrally disposed laterally relative to the axis 40 of the brake beam assembly 30.

The method of designing a brake beam assembly for a railcar comprises the steps of: determining in which lateral direction the brake beam formation 32 is going to move upon actuation of the brake beam lever 48, 50; and configuring the brake beam assembly 30 so as to allow the brake beam assembly 30 to reciprocate relative to the trucks 14, 14' while inhibiting a brake shoe 45 carried by either the first or second brake head assembly 42, 42' from engaging with the flange 28 on either wheel 26, 26' upon actuation of the brake beam lever 48, 50 whereby optimizing brake beam assembly performance.

The step of determining in which lateral direction the brake beam formation 32 is going to move upon actuation of the brake beam lever 48, 50 can be accomplished by analyzing the construction of the brake beam assembly 30 and brake rigging 46. That is, by analyzing the construction of the brake beam assembly 30 and, more particularly, the angular inclination of the brake levers 48, 50 coupled with the locations where the connecting rod 52 is connected to the brake levers 48, 50, a determination in which lateral direction the brake beam formation 32 is going to move upon actuation of the brake beam lever 48, 50 can be achieved. As such, the brake beam assembly 30 can be configured to inhibit a brake shoe 45 carried by either the first or second brake head assembly 42, 42' from engaging with the flange 28 on the adjacent car wheel 26, 26' upon actuation of the brake beam lever 48, 50

From the foregoing, it will be observed that numerous modifications and variations can be made and effected without departing or detracting from the true spirit and novel concept of this invention disclosure. Moreover, it will be appreciated, the present disclosure is intended to set forth an exemplification which is not intended to limit the disclosure to the specific embodiment illustrated. Rather, this disclosure is intended to cover by the appended claims all such modifications and variations as fall within the spirit and scope of the claims.

What is claimed is:

1. A railcar brake beam assembly, comprising:

a brake beam formation including a tension member, a compression member and strut disposed between and operably joined to the tension member and the compression member, with said strut defusing an axis;

first and second brake head assemblies disposed to opposite lateral sides of said axis, with each brake head assembly being operably carried by said brake beam formation and includes a guide member extending in a direction away from said axis; and wherein a distal end of the guide member on said first brake head assembly is disposed a different lateral distance from said axis than is a distal end of the guide member on said second brake head assembly.

2. The railcar brake beam assembly according to claim 1, wherein each brake head assembly includes a brake head, a brake shoe removably attached to said brake head, and with said guide member being formed as an integral part of said brake head.

3. The railcar brake beam assembly according to claim 1, wherein each brake head assembly operably interconnects adjacent ends of said tension member and said compression member to each other.

4. The railcar brake beam assembly according to claim 1, wherein the guide member on each brake head assembly includes two free-ended lobes extending in generally coplanar relation relative to each other.

5. The railcar brake beam assembly according to claim 4, wherein the lobes of each guide member are separated from each other as they extend away from the distal end of each guide member.

6. The railcar brake beam assembly according to claim 1, wherein the strut of said brake beam formation defines an elongated slot which is slanted at a predetermined angle relative to a horizontal plane.

7. A brake beam assembly for a railcar having laterally spaced side frames mounting at least one axle therebetween, with said axle carrying a pair of wheels, with each wheel having a radial flange thereon, and with said brake beam assembly comprising:

a brake beam formation including a tension member, a compression member and strut disposed between and operably joined to the tension member and the compression member, with said strut defining an axis for said brake beam assembly, and with said strut serving to mount a brake beam lever for pivotal movement about a fixed axis;

first and second brake head assemblies disposed to opposite lateral sides of said axis, with each brake head assembly being adapted to apply a braking force to a respective one of said flanged wheels in response to actuation of said brake beam lever, with each brake head assembly being operably carried by said brake beam formation and includes a guide member extending in a direction away from said axis, and with said first and second brake head assemblies being generally centrally disposed laterally relative to the axis of said brake beam assembly wherein said brake beam assembly is configured such that distal ends of the guide members on said first and second brake head assemblies are disposed different distances from the axis for said brake beam assembly so as to inhibit a brake shoe carried by said either brake head assembly from engaging with the flange on either wheel upon actuation of said brake beam lever and whereby yielding an asymmetrical design to the brake beam assembly.

8. The railcar brake beam assembly according to claim 7, wherein each brake head assembly includes a brake head, a brake shoe removably attached to said brake head, and with said guide member being formed as an integral part of said brake head.

9. The railcar brake beam assembly according to claim 7, wherein each brake head assembly operably interconnects adjacent ends of said tension member and said compression member to each other.

10. The railcar brake beam assembly according to claim 7, wherein the guide member on each brake head assembly includes two free-ended lobes extending in generally coplanar relation relative to each other.

11. The railcar brake beam assembly according to claim 10, wherein the lobes of each guide member are separated from each other as they extend away from the distal end of each guide member.

12. The railcar brake beam assembly according to claim 7, wherein the strut of said brake beam formation defines an elongated slot which is slanted at a predetermined angle relative to a horizontal plane.

13. A brake beam assembly for a railcar having laterally spaced side frames mounting at least one axle therebetween, with said axle carrying a pair of wheels, with each wheel having a radial flange thereon, and with each side frame presenting on an inboard side thereof a guide recess, said brake beam assembly comprising:

a brake beam formation including a tension member, a compression member and strut disposed between and operably joined to the tension member and the compression member, with said strut defining an axis for said brake beam assembly, and with said strut mounting a brake beam lever at an angle relative to a horizontal plane;

first and second brake head assemblies arranged a generally equal lateral distance relative to and on opposite lateral sides of the axis, with each brake head assembly being adapted to apply a braking force to a respective one of said flanged wheels in response to actuation of said brake beam lever, with each brake head assembly being operably carried by said brake beam formation and includes a guide member extending in a direction away from said axis, with the guide member of each brake head assembly being slidably supported for reciprocal movements within the guide recess defined by the inboard side of the laterally adjacent side frame; and wherein said brake beam assembly is configured such that distal ends of the guide members on said first and second brake head assemblies are disposed different distances from the axis for said brake beam assembly so as to inhibit a brake shoe carried by either brake head assembly from overhanging either wheel upon actuation of said brake beam lever whereby optimizing brake beam assembly performance.

14. The railcar brake beam assembly according to claim 13, wherein each brake head assembly includes a brake head, a brake shoe removably attached to said brake head, and with said guide member being formed as integral part of said brake head.

15. The railcar brake beam assembly according to claim 13, wherein each brake head assembly operably interconnects adjacent ends of said tension member and said compression member to each other.

16. The railcar brake beam assembly according to claim 13, wherein the guide member on each brake head assembly includes two free-ended lobes extending in generally coplanar relation relative to each other.

17. The railcar brake beam assembly according to claim 16, wherein the lobes of each guide member are separated from each other as they extend away from the distal end of each guide member.

18. The railcar brake beam assembly according to claim 13, wherein the strut of said brake beam formation defines an elongated slot which is slanted at a predetermined angle relative to a horizontal plane.

19. A method of designing a brake beam assembly for a railcar having laterally spaced side frames mounting at least one axle therebetween, with said axle carrying a pair of wheels, with each wheel having a radial flange thereon, a brake beam formation including a tension member, a compression member and strut disposed between and operably joined to the tension member and the compression member, with said strut defining an axis for said brake beam assembly, and with said strut serving to mount a brake beam lever for pivotal movement about a fixed axis, first and second brake head assemblies disposed to opposite lateral sides of said axis, with each brake head assembly being adapted to apply a braking force to a respective one of said flanged wheels in response to actuation of said brake beam lever, with each brake head assembly being operably carried by said brake beam formation and includes a guide member extending in a direction away from said axis, and with said first and second brake head assemblies being generally centrally disposed laterally relative to the axis of said brake beam assembly, with said method comprising the steps of:

determining in which lateral direction said brake beam formation is going to move upon actuation of said brake beam lever; and configuring said brake beam assembly so as to allow said brake beam assembly to reciprocate relative to said side frames and such that distal ends of the guide members on said first and second brake head assemblies are disposed different distances from the axis for said brake beam assembly to inhibit a brake shoe carried by either the first or second brake head assembly from overhanging a respective wheel upon actuation of said brake beam lever whereby optimizing brake beam assembly performance.

* * * * *